US007530903B2

(12) United States Patent
Imamoto et al.

(10) Patent No.: US 7,530,903 B2
(45) **Date of Patent: *May 12, 2009**

(54) GOLF CLUB HEAD

(75) Inventors: Yasunori Imamoto, Tokyo (JP); Hisashi Yamagishi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 480 days.

This patent is subject to a terminal disclaimer.

(21) Appl. No.: 11/240,364

(22) Filed: Oct. 3, 2005

(65) Prior Publication Data

US 2006/0073910 A1 Apr. 6, 2006

(30) Foreign Application Priority Data

Oct. 4, 2004 (JP) ..... 2004-291558

(51) Int. Cl.
*A63B 53/04* (2006.01)

(52) U.S. Cl. ..... 473/335; 473/345; 473/347; 473/349

(58) Field of Classification Search ..... 473/324–350, 473/287–292

See application file for complete search history.

(56) References Cited

U.S. PATENT DOCUMENTS

| | | | | |
|---|---|---|---|---|
| 3,652,094 | A | 3/1972 | Glover | |
| 3,976,299 | A * | 8/1976 | Lawrence et al. | 473/327 |
| 4,021,047 | A | 5/1977 | Mader | |
| 4,432,549 | A | 2/1984 | Zebelean | |
| 4,438,931 | A | 3/1984 | Motomiya | |
| 5,205,560 | A | 4/1993 | Hoshi et al. | |
| 5,255,913 | A | 10/1993 | Tsuchida | |
| 5,547,427 | A | 8/1996 | Rigal et al. | |
| 5,570,886 | A | 11/1996 | Rigal et al. | |
| 5,624,331 | A | 4/1997 | Lo et al. | |
| 5,669,827 | A | 9/1997 | Nagamoto | |
| 5,766,095 | A | 6/1998 | Antonious | |
| 5,967,904 | A | 10/1999 | Nagai et al. | |
| 5,997,415 | A | 12/1999 | Wood | |

(Continued)

FOREIGN PATENT DOCUMENTS

JP 4-89071 A 3/1992

(Continued)

OTHER PUBLICATIONS

Japanese Office Action dated Nov. 2, 2006 issued in JP Patent Application No. 2002-178798.

(Continued)

*Primary Examiner*—Sebastiano Passaniti
(74) *Attorney, Agent, or Firm*—Sughrue Mion, PLLC

(57) ABSTRACT

A hollow golf club head includes a face portion made of metal, a sole portion, a side portion, a crown portion, and a hosel portion. The crown portion includes a main portion made of a fiber reinforced resin, and a front edge portion made of the metal. The front edge portion of the crown portion is continuous with the face portion. The sole portion comprises a center portion made of the metal in a toe-heel direction. A weight of a portion made of the fiber reinforced resin including the main portion of the crown portion is in a range of 5% to 30% of a total weight of the golf club head.

13 Claims, 8 Drawing Sheets

U.S. PATENT DOCUMENTS

| | | | | |
|---|---|---|---|---|
| 6,010,411 | A | 1/2000 | Reyes | |
| 6,089,992 | A | 7/2000 | Onuki et al. | |
| 6,162,130 | A | 12/2000 | Masumoto et al. | |
| 6,162,132 | A * | 12/2000 | Yoneyama | 473/338 |
| 6,248,025 | B1 | 6/2001 | Murphy et al. | |
| 6,254,494 | B1 | 7/2001 | Hasebe et al. | |
| 6,332,847 | B2 | 12/2001 | Murphy et al. | |
| 6,340,337 | B2 | 1/2002 | Hasebe et al. | |
| 6,354,962 | B1 | 3/2002 | Galloway et al. | |
| 6,354,963 | B1 | 3/2002 | Kodama et al. | |
| 6,371,868 | B1 | 4/2002 | Galloway et al. | |
| 6,381,828 | B1 | 5/2002 | Boyce et al. | |
| 6,406,378 | B1 | 6/2002 | Murphy et al. | |
| 6,435,977 | B1 | 8/2002 | Helmstetter et al. | |
| 6,435,978 | B1 | 8/2002 | Galloway et al. | |
| 6,440,008 | B2 | 8/2002 | Murphy et al. | |
| 6,440,011 | B1 | 8/2002 | Hocknell et al. | |
| 6,471,604 | B2 | 10/2002 | Hocknell et al. | |
| 6,491,592 | B2 | 12/2002 | Cackett et al. | |
| 6,524,194 | B2 | 2/2003 | McCabe | |
| 6,524,198 | B2 | 2/2003 | Takeda | |
| 6,527,650 | B2 | 3/2003 | Reyes et al. | |
| 6,575,845 | B2 | 6/2003 | Galloway et al. | |
| 6,582,321 | B2 | 6/2003 | Galloway et al. | |
| 6,582,323 | B2 | 6/2003 | Soracco et al. | |
| 6,602,149 | B1 | 8/2003 | Jacobson | |
| 6,607,452 | B2 | 8/2003 | Helmstetter et al. | |
| 6,620,056 | B2 | 9/2003 | Galloway et al. | |
| 6,623,378 | B2 | 9/2003 | Beach et al. | |
| 6,648,774 | B1 | 11/2003 | Lee | |
| 6,676,536 | B1 | 1/2004 | Jacobson | |
| 6,739,982 | B2 | 5/2004 | Murphy et al. | |
| 6,739,983 | B2 * | 5/2004 | Helmstetter et al. | 473/342 |
| 6,739,984 | B1 | 5/2004 | Ciasullo | |
| 6,872,152 | B2 | 3/2005 | Beach et al. | |
| 6,945,876 | B2 | 9/2005 | Nakahara et al. | |
| 7,344,452 | B2 * | 3/2008 | Imamoto et al. | 473/345 |
| 2001/0049310 | A1 | 12/2001 | Cheng et al. | |
| 2002/0160858 | A1 | 10/2002 | Lee | |
| 2003/0083151 | A1 | 5/2003 | Nakahara et al. | |
| 2003/0125127 | A1 | 7/2003 | Nakahara et al. | |
| 2003/0134692 | A1 | 7/2003 | Nakahara et al. | |
| 2003/0134693 | A1 | 7/2003 | Nakahara et al. | |
| 2004/0005936 | A1 | 1/2004 | Imamoto et al. | |
| 2004/0116208 | A1 | 6/2004 | De Shiell et al. | |
| 2004/0266551 | A1 | 12/2004 | Noguchi et al. | |
| 2005/0020379 | A1 * | 1/2005 | Kumamoto | 473/332 |
| 2006/0063608 | A1 | 3/2006 | Mori et al. | |

FOREIGN PATENT DOCUMENTS

| | | | |
|---|---|---|---|
| JP | 05-068725 | | 3/1993 |
| JP | 06-039941 | | 2/1994 |
| JP | 7-406 | U | 1/1995 |
| JP | 07-112041 | A | 5/1995 |
| JP | 07-112042 | A | 5/1995 |
| JP | 07-155410 | | 6/1995 |
| JP | 08-024377 | | 1/1996 |
| JP | 09-038250 | | 2/1997 |
| JP | 09-187534 | | 7/1997 |
| JP | 09-215786 | | 8/1997 |
| JP | 09-322953 | | 12/1997 |
| JP | 10-015119 | | 1/1998 |
| JP | 11-319167 | A | 11/1999 |
| JP | 2000-024149 | A | 1/2000 |
| JP | 2000-033133 | | 2/2000 |
| JP | 2000-167090 | A | 6/2000 |
| JP | 2003-320060 | | 11/2000 |
| JP | 2001-062003 | A | 3/2001 |
| JP | 2001-087426 | A | 4/2001 |
| JP | 2001-149514 | A | 6/2001 |
| JP | 2001-309998 | A | 11/2001 |
| JP | 2001-321474 | A | 11/2001 |
| JP | 2001-340499 | | 12/2001 |
| JP | 2002-000773 | A | 1/2002 |
| JP | 2002-011122 | | 1/2002 |
| JP | 2002-224249 | | 8/2002 |
| JP | 2003-062130 | | 3/2003 |
| JP | 2003-144590 | | 5/2003 |
| JP | 2003-205055 | A | 7/2003 |
| JP | 2004-016654 | | 1/2004 |
| JP | 2004-065810 | | 3/2004 |
| JP | 2004-180759 | | 7/2004 |
| WO | WO 2004/052472 | A1 | 6/2004 |

OTHER PUBLICATIONS

Japanese Office Action dated Jan. 22, 2007 issued in JP Patent Application No. 2002-178798.

Japanese Office Action dated May 8, 2007 issued in JP Patent Application No. 2002-178798.

* cited by examiner

GOLF CLUB HEAD

BACKGROUND OF THE INVENTION

1. Field of the Invention

The invention relates to a hollow golf club head, and more particularly to a golf club head having a wood-type shape or a similar shape thereto.

2. Description of the Related Art

As wood-type golf club heads such as drivers and fairway woods, hollow metallic heads are widely in use. Generally, the hollow wood-type golf club head has a face portion for hitting a ball; a crown portion constituting an upper surface portion of the golf club head; a sole portion constituting a bottom surface portion of the golf club head; a side portion constituting side surface portions on the toe side, the rear side, and the heel side of the golf club head; and a hosel portion. A shaft is inserted into the hosel portion, and is fixed by a bonding adhesive or the like. Recently, golf clubs called utility clubs are also commercially available in large numbers, and various golf clubs having a head similar to the aforementioned wood-type golf club head (i.e., having the face portion, the sole portion, the side portion, the crown portion, and the hosel portion) are also commercially available.

Aluminum alloy, stainless steel, and a titanium alloy are used as metal forming this hollow golf club head. In particular, titanium alloy has come to be used widely in recent years.

It becomes possible to enlarge the sweet spot, by increasing the volume of the hollow golf club head. To prevent an increase in the weight of the golf club head in consequence of the increase in the volume thereof, it has been conceived to adopt a fiber reinforced resin whose specific gravity is far smaller than metals. In this case, since the face surface for hitting the ball needs to be made of metal to ensure the strength, portions other than the face portion are consequently made of the fiber reinforced resin.

For example, US 2004/0005936 A1 discloses a golf club head adopting the carbon fiber reinforced thermosetting resin (CFRP).

SUMMARY OF THE INVENTION

The invention provides a fairway wood golf club head in which the weight of the fiber reinforced resin portion is appropriate.

According to one embodiment of the invention, a hollow golf club head includes a face portion made of metal, a sole portion, a side portion, a crown portion, and a hosel portion. The crown portion includes a main portion made of a fiber reinforced resin, and a front edge portion made of the metal. The front edge portion of the crown portion is continuous with the face portion. The sole portion comprises a center portion made of the metal in a toe-heel direction. A weight of a portion made of the fiber reinforced resin including the main portion of the crown portion made of the fiber reinforced resin is in a range of 5% to 30% of a total weight of the golf club head.

According to this structure, the weight of the portion made of the fiber reinforced resin is appropriate, so that the golf club head is easy to swing.

The golf club head may further include a first weight member made of a metal material. A front edge portion of the side portion and a front edge portion of the sole portion may be made of the metal and be continuous with the face portion. A metallic portion of the sole portion may extend to a rear face portion of the golf club head. The first weight member is provided at a rear portion of the metallic portion of the sole portion.

Also, a weight of the first weight member may be in a range of 10% to 25% of the total weight of the golf club head.

According to this structure, the first weight member is provided in the rear portion, so that the depth of the center of gravity is large.

A sole-face side of the first weight member may be covered with a metal or a resin.

According to this structure, since the first weight member is covered with the metal or the resin, it is possible to enhance the aesthetic appearance of the sole portion.

The golf club head may further include a second weight member made of a metal material provided in a front portion of the metallic portion of the sole portion.

According to this structure, since the second weight member is provided, the degree of freedom in designing the center of gravity and the moment of inertia of the golf club head is high.

A recess recessed from a sole surface may be formed in the metallic portion of the sole portion. The second weight member is disposed in the recess.

According to this structure, the weight member can be firmly attached to the metallic portion from the outer surface side of the golf club head.

The second weight member may be a plurality of second weight members. The second weight members are provided on a toe side and a heel side of the sole portion, respectively.

Also, recesses may formed in the sole portion on the toe side and the heel side, respectively. The second weight members are disposed in the respective recesses.

According to this structure, since the second weight members are disposed on the toe side and the heel side, respectively, the sweet area becomes large in the toe-heel direction.

A sole-face side of the second weight member may be covered with a metal or a resin.

According to this structure, it is possible to enhance the aesthetic appearance of the sole portion.

A groove portion, which is recessed from a sole face and extends in the toe-heel direction, may be formed around the recess. A fiber reinforced resin continuous with the main portion of the crown portion may be disposed in the groove portion to cover the second weight member.

According to this structure, it is possible to enhance the aesthetic appearance of the sole portion, and the holding of the second weight members can be made further sold.

The face portion may be formed of a face plate made by forging or press-molding. Components of the golf club head other than the face portion may be made by casting. The face plate may be fixed to the cast components.

A thickness of the face plate in a vicinity of a center portion thereof may be larger than that of a peripheral edge portion of the face plate.

According to this structure, it is possible to increase the repulsion of the face portion.

DETAILED DESCRIPTION OF THE EMBODIMENTS OF THE INVENTION

Figure 1:
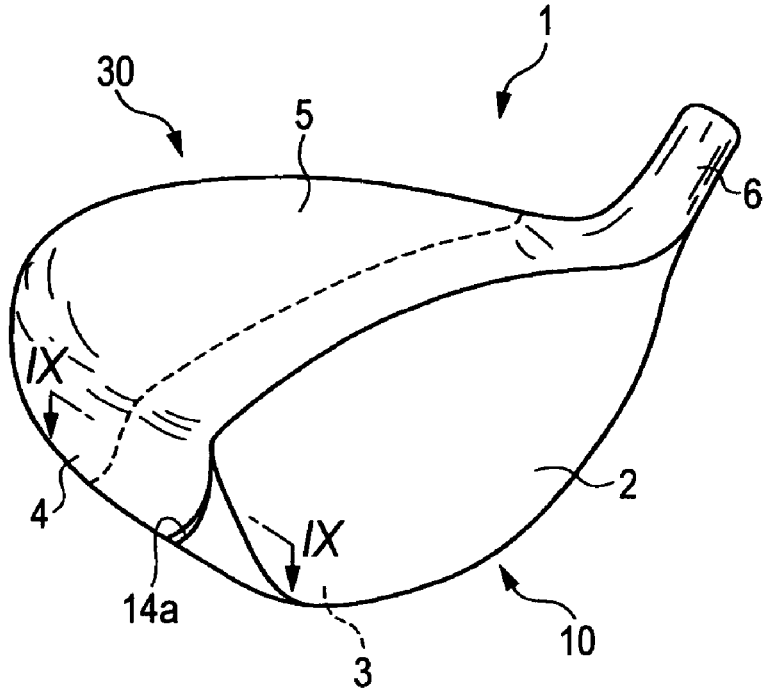
FIG. 1 is a perspective view of a golf club head according to an embodiment.
Figure 2:
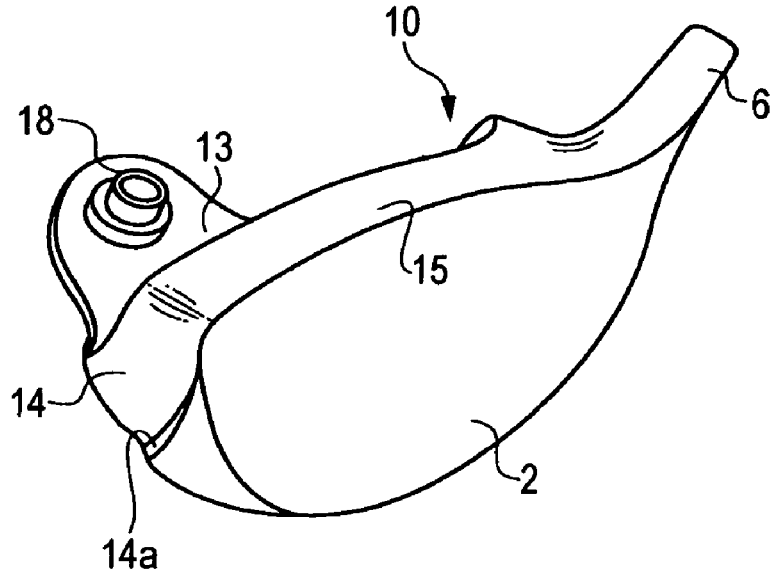
FIG. 2 is a perspective view of a metal body of the golf club head shown in FIG. 1 as viewed from the front side thereof.
Figure 3:
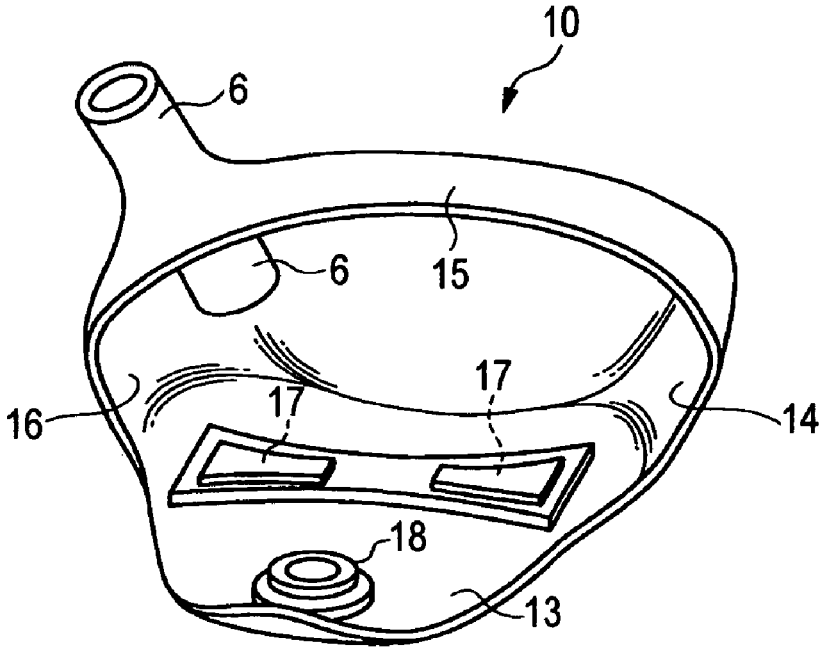
FIG. 3 is a perspective view of the metal body of the golf club head shown in FIG. 1 as viewed from the rear side thereof.
Figure 4:
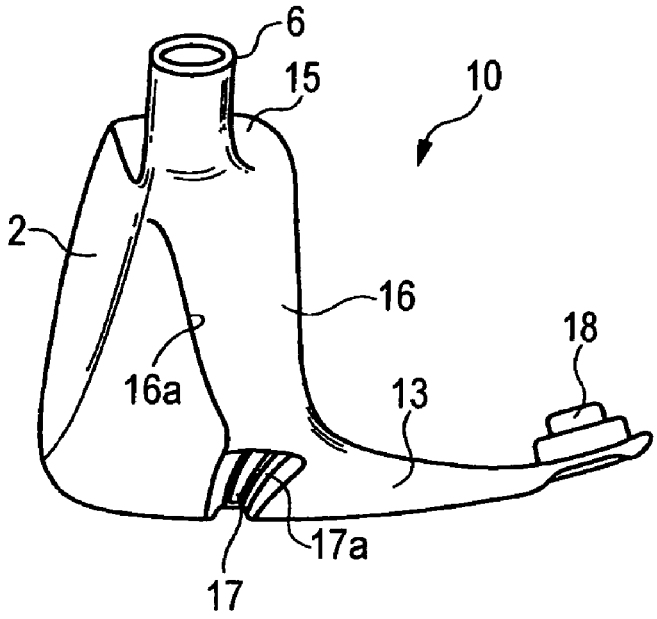
FIG. 4 is a side view of the metal body of the golf club head shown in FIG. 1 as viewed from a heel side thereof.
Figure 5:
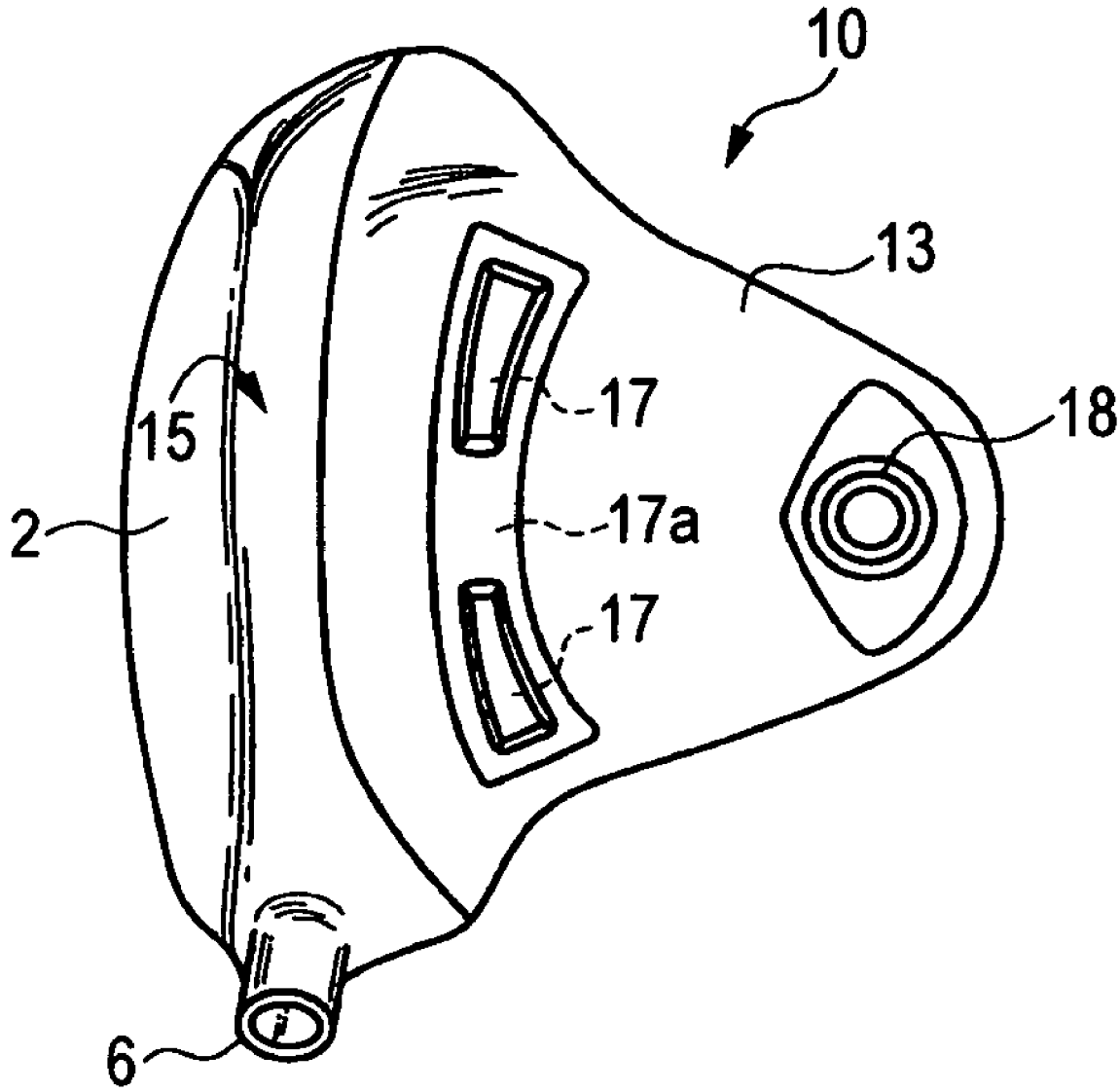
FIG. 5 is a plan view of the metal body of the golf club head shown in FIG. 1.
Figure 6A:
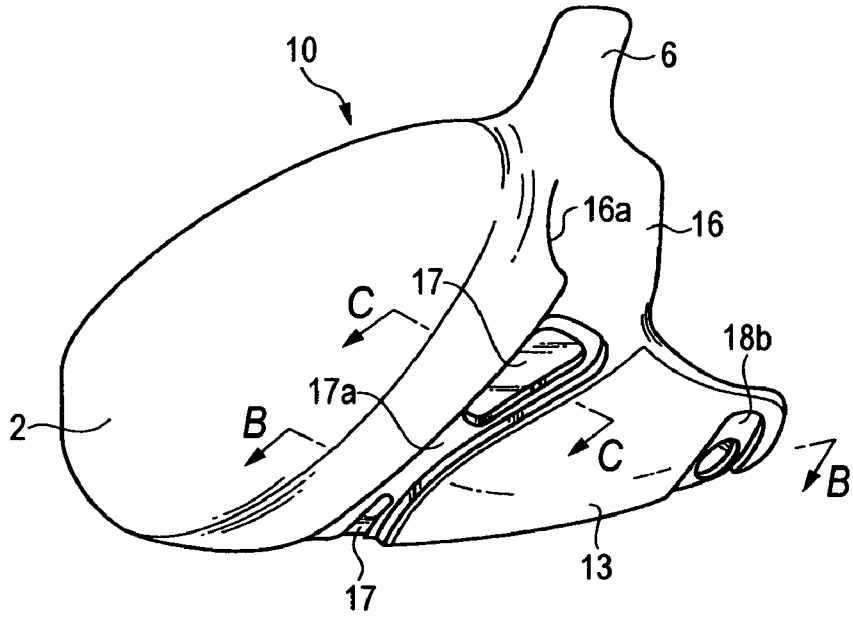
FIG. 6A is a perspective view of the metal body of the golf club head shown in FIG. 1 as viewed from a sole side thereof.
Figure 6B:
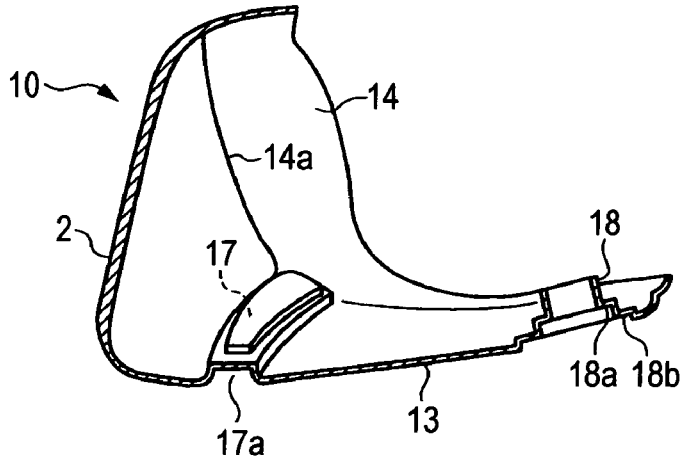
FIGS. 6B and 6C are section views taken along line B-B and line C-C, respectively, in FIG. 6A.
Figure 6C:
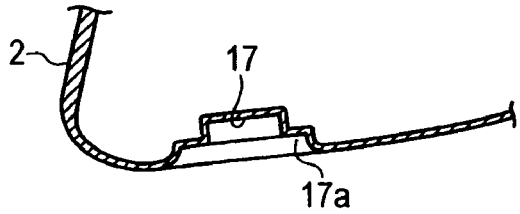

Hereafter, a description will be given of embodiments of the invention with reference to the drawings.

This golf club head 1 is a hollow wood-type golf club head having a face portion 2, a sole portion 3, a side portion 4, a crown portion 5, and a hosel portion 6.

The face portion 2 is a surface for hitting a ball, and is provided with grooves (scoring lines), which are not shown. The sole portion 3 constitutes a bottom portion of the golf club head 1. The side portion 4 constitutes side surface portions on the toe side, the heel side, and the rear-surface side of the golf club head 1. The crown portion 5 constitutes an upper surface portion of the golf club head 1. A shaft is inserted into the hosel portion 6, and is secured by means of a bonding adhesive.

This golf club head 1 includes a metal body 10 and a fiber reinforced resin body (hereafter referred to as the FRP body) 30.

The metal body 10 has the face portion 2, a metal sole portion 13, a metal side portion (toe) 14, a metal crown portion 15, a metal side portion (heel) 16, recesses 17, an annular portion 18 and the hosel portion 6. The recesses 17 are formed in the metal sole portion 13 on the toe side and the heel side, respectively. The annular portion 18 is formed in the rear portion of the metal sole portion 13.

The metal crown portion 15, which constitutes a front edge portion of the crown portion 5, is continuous with the metal side portion (toe) 14 and the metal side portion (heel) 16. The metal side portion (toe) 14 and the metal side portion (heel) 16 are respectively continuous with the metal sole portion 13. The metal crown portion 15, the metal side portions 14 and 16, and the metal sole portion 13 are continuous with the face portion 2.

A front portion of the metal sole portion 13 extends over an entire width of the golf club head 1 from the toe side to the heel side. The width of the metal sole portion 13 becomes gradually narrow from the front portion thereof toward the rear portion thereof. The rear portion of the metal sole portion 13 is in a center portion in the heel-toe direction of the golf club head 1.

Shallow recesses 17 are respectively formed in the front portion of the metal sole portion 13 on the toe side and the heel side. Each recess 17 extends in the toe-heel direction. A shallow groove portion 17*a* extending in the toe-heel direction is formed in a front region of the metal sole portion 13 including these recesses 17. The transverse width of this groove portion 17*a* is large on the toe side and the heel side, and is small in the vicinity of its center in the toe-heel direction. The groove portion 17*a* surrounds the recesses 17.

Second weight members 20 are respectively accommodated in the recesses 17. A resin plate 21 formed of a resin molded piece is fitted to the groove portion 17*a* to cover the second weight members 20.

An FRP layer 22 formed of a cured body of a cloth fiber prepreg covers the resin plate 21. The FRP layer 22 is continuous and integral with the FRP body 30, as will be described later.

Figure 7:
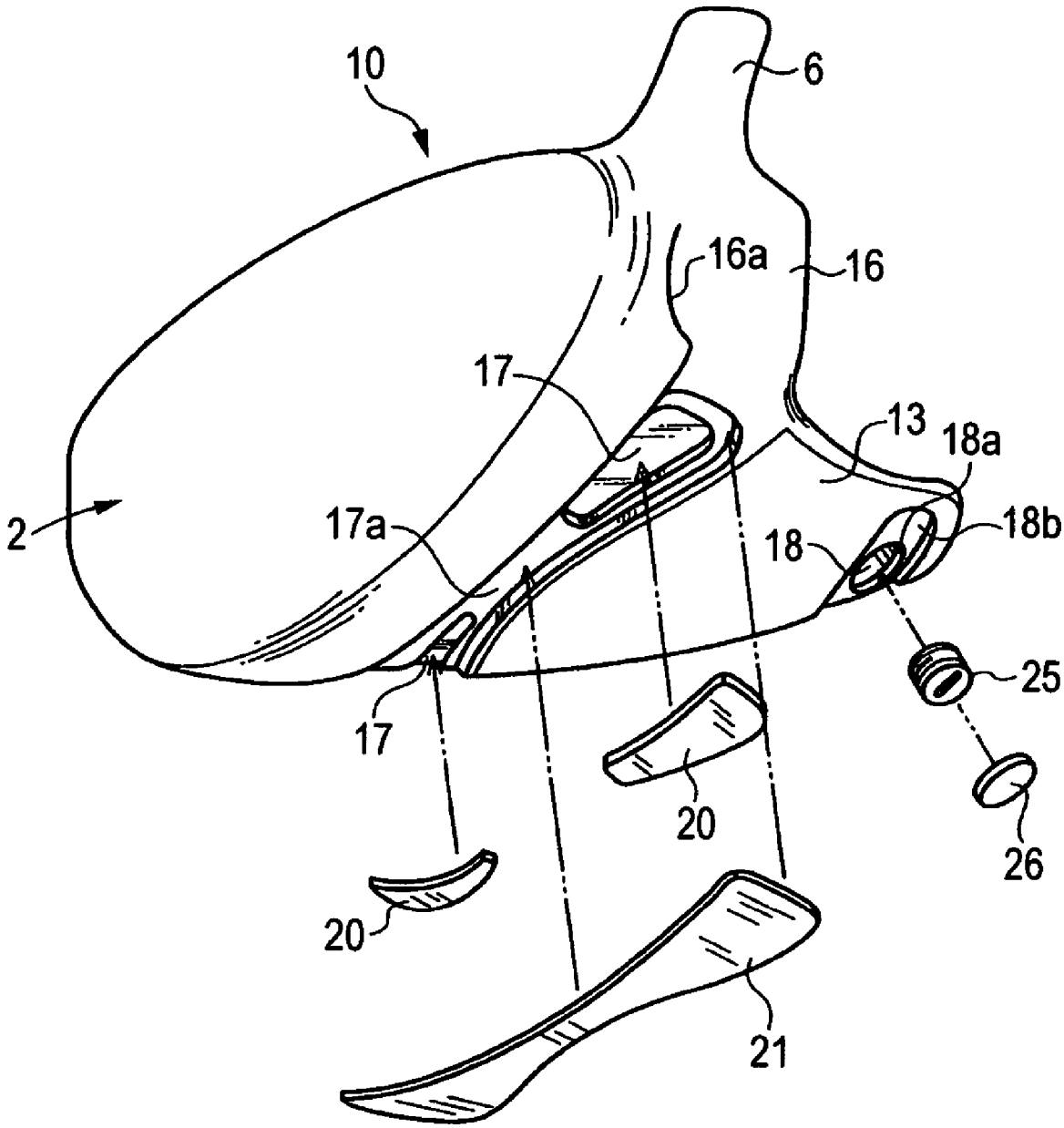
FIG. 7 is an exploded perspective view for explaining attachment of weight members to the metal body.
Figure 8A:
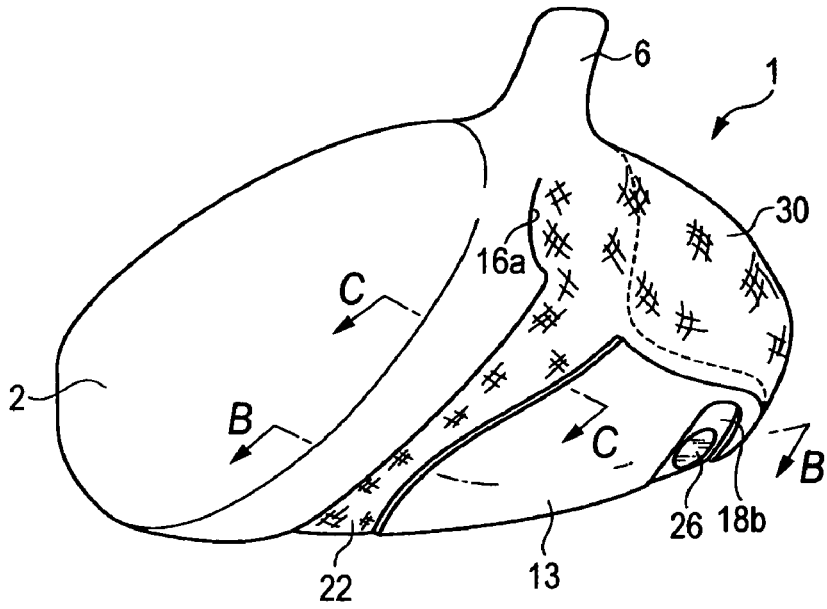
FIG. 8A is a perspective view of the golf club head as viewed from the sole side thereof.
Figure 8B:
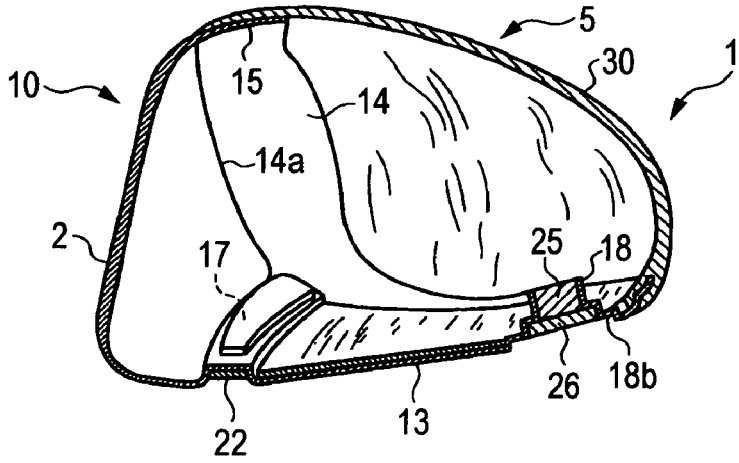
FIGS. 8B and 8C are section views taken along line B-B and line C-C, respectively, in FIG. 8A.
Figure 8C:
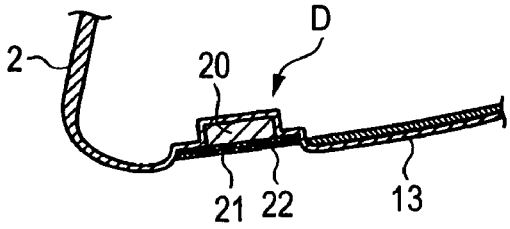
Figure 8D:
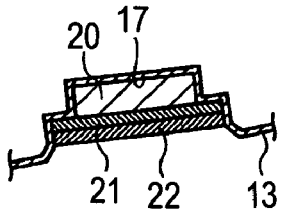
FIG. 8D is an enlarged view of a portion D in FIG. 8C.

The rear portion of the metal sole portion 13 rises up rearward obliquely. The annular portion 18 is integrated with the rear portion of this metal sole portion 13. An internal thread (not shown) is provided on an inner peripheral surface of the annular portion 18, and a screw-like first weight member 25 is screwed thereinto as shown in FIGS. 7 and 8. A first annular recessed portion 18*a* surrounding the annular portion 18 and a second annular recessed portion 18*b* surrounding the first annular recessed portion 18*a* are formed in the metal sole portion 13. A circular plate 26 made of aluminum is fitted and fixed to the first annular recessed portion 18*a* by interference fit.

The face portion 2 is formed of a face plate (not shown) made by forging or press molding. The other portions of the metal body 10 are made by forging. As for this forged piece, an opening is formed in its face portion, and the face plate is fitted into this opening and is secured by caulking, welding, or the like.

The face portion 2 is thick in its center portion and is thin in its peripheral edge portion, thereby to have high repulsion.

The FRP body 30 constitutes the remaining portion of the outer surface of this golf club head 1. Namely, the FRP body 30 has a size for making up substantially the entirety of the crown portion 5, a rear half portion of the side portion 4, and a portion of the sole portion 3 other than the metal sole portion 13.

Figure 9:
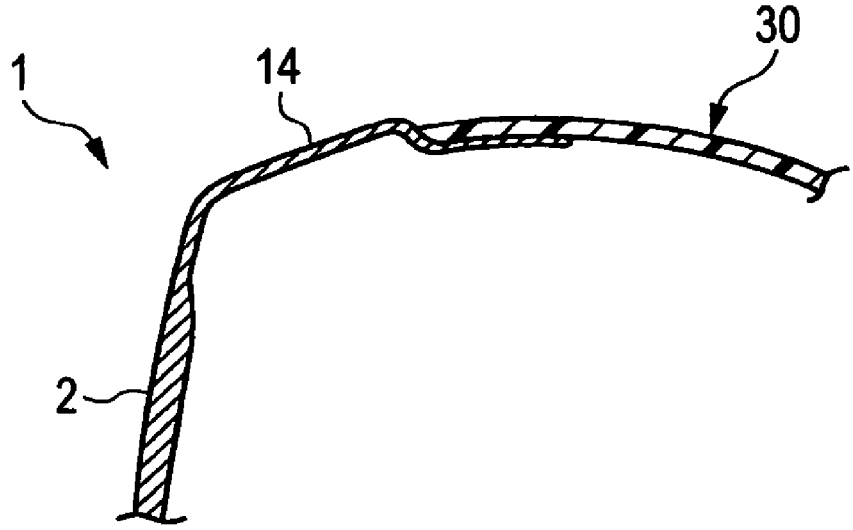
FIG. 9 is a section view taken along line IX-IX in FIG. 1.

As shown in FIGS. 8 and 9 in the enlarged form, the FRP body 30 is closely adhered to outer surfaces of the metal crown portion 15, the metal side portion 14 (both on the toe and heel sides), and the metal sole portion 13.

In the crown portion 5, the FRP body 30 extends to the vicinity of the frontmost edge of the upper surface of the metal crown portion 15. On the heel side and the sole side of the side portion 4, stepped portions 14*a* and 16*a* are formed in the metal body 10. The FRP body 30 extends to the stepped portions 14*a* and 16*a*. The stepped portions 14*a* and 16*a* are steps where the back side is recessed.

To form the FRP body 30 and integrate it with the metal body 10, a mold having an outline shape of the golf club head 1 is prepared, and a first prepreg sheet (an uncured resin-fiber composite sheet) in which fibers are oriented in two orthogonal directions is laid along the inner surface of the mold. This first prepreg sheet is laid on the entire outer surface of the FRP body 30 and at a position for covering the aforementioned groove portion 17*a*.

Next, a plurality of second prepreg sheets in which fibers are oriented in one direction are superposed on the first prepreg sheet. The plurality of second prepreg sheets are laminated such that the directions of the fibers are alternate.

Next, the metal body 10, to which the first weight members 25 and the resin plate 21 have been fitted but the second weight member 20 and the circular plate 26 have not been fitted, is placed in the mold.

Next, a third prepreg sheet is superposed on the metal sole portion 13 of the metal body 10 (posterior to the groove portion 17*a*, and excluding the annular portion 18). Subsequently, this assembly is heated in a state where gas pressure is applied to its interior through the opening in the annular portion 18, thereby allowing the resin to cure. At this juncture, a resin bag made of nylon or the like may be placed in advance inside the golf club head 1, and gas may be supplied into this bag to inflate it, thereby allowing the prepreg sheets to be pressed and brought into close contact with the inner surface of the mold.

Consequently, the FRP body 30 is formed, and the peripheral edge portion of the FRP body 30 is brought into close contact with the metal body 10, as shown in FIG. 8. In addition, the resin plate 21 is covered with the FRP layer 22 formed of the cured piece of the first prepreg sheet. After completing the molding, the mold is released, and a vibration absorbing layer and a hitting-sound adjusting layer are formed on the inner surface of the golf club head, if necessary. For example, an adhesive including polyisobutyrene is pasted in a layered state, thereby to prevent rattling sound from occurring in the golf club head 1.

Next, the first weight member 25 is screwed into the annular portion 18, and then the metal plate 26 made of aluminum is fitted and secured into the first annular recessed portion 18*a*. Subsequently, polishing and painting are performed with respect to the outer surface of this golf club head if necessary, thereby to form a golf club head product.

In this golf club head 1, the weight of the FRP body 30 and the weight of the metal body 10 (including the weight members 20 and 25) are determined so that the weight of the FRP body 30 is equal to 5% to 30%, preferably 10% to 25%, more preferably 15% to 20%, of the total weight of the golf club head 1.

The total weight of the golf club head 1 is preferably in a range of 175 g to 250 g. If the loft angle of the golf club head 1 is less than 13°, the total weight of the golf club head 1 is preferably in a range of 175 g to 200 g or thereabout. As a constituent material of the metal body 10 other than the weight members, titanium alloy, stainless steel, maraging steel, copper alloy, zirconium alloy, or the like is suitable. In particular, among others, titanium alloy such as Ti-6Al-4V is suitable.

In the case where the face plate is made by forging or press molding, titanium alloy (particularly ◘type) such as Ti-6Al-4V, Ti-15V-3Cr-3Sn-3Al, and T-22V-4Al is preferable as material of the face plate. It is possible to enhance the strength and hardness of ◘type titanium alloy by heat treatment after plastic working.

In the case where forging is carried out, investment forging is suitable. In order to ensure that molten metal reaches up to thin-walled portions sufficiently, it is preferable to perform vacuum forging or centrifugal forging.

As the weight members, tungsten or tungsten alloy having the specific gravity of 10 or greater, preferably 12 or greater, is suitable.

In the case where the metal body 10 is made of titanium alloy, not only the above-described materials, but also stainless steel, a copper alloy and lead may be used for the weight members.

The second weight members 20 may be fixed to the recesses 17 by caulking, press fitting, or bonding with a bonding adhesive.

The first weight member 25 may be fixed to the annular member 18 by brazing or welding.

As a prepreg for molding the FRP body 30, it is possible to use any one of a cloth fiber prepreg, a unidirectional fiber prepreg, and the like. In a case where an SMC prepreg is used as this prepreg, it is possible to easily form the thin-walled FRP body 30.

The FRP body 30 is preferably formed by laminating three to eight prepregs or thereabouts.

As fibers in the prepreg, carbon fibers or the like having elastic modulus of $20\times10^3$ to $30\times10^3$ kg/mm$^2$ or thereabouts are preferable, but the invention is not limited thereto.

The elastic modulus in the transverse direction at the crown portion 5 can be made lower than that in the toe-heel direction, by adjusting the orientation of the fibers. For example, the cloth fiber prepregs and the unidirectional fiber prepregs are alternately laminated, and the direction of orientation of the fibers of these unidirectional fiber prepregs is set in the toe-heel direction.

A thermosetting resin such as epoxy may be used as the resin of the FRP body 30. A small amount of thermoplastic resin may be mixed in the thermosetting resin, thereby making it possible to improve the vibration absorbing property.

The thickness of the FRP body 30 is preferably in a range of 1 mm to 3 mm. In particular, the thickness of the crown portion 5 thereof is preferably in a range of 1 mm to 2 mm, especially 1 mm to 1.5 mm, e.g., approximately 1.3 mm or thereabouts.

The invention is suitably applied to a large-size head having a size of 300 cm$^3$ or greater, particularly 350 cm$^3$ or greater, e.g., in a range of 350 cm$^3$ to 400 cm$^3$. There is no upper limit to the size of the head. It is technically possible to manufacture a large-size head of 600 cm$^3$ or thereabouts.

This golf club head 1 is easy to swing since the weight of the FRP body 30 is appropriate. In addition, since the depth of the center of gravity is deep and the second weight members 20 are provided, the sweet area in the toe-heel direction is large. Further, the degree of freedom in designing a position of the center of gravity is large. Since the second weight members 20 are covered with the FRP cured layer 22, the aesthetic appearance is excellent. The first weight member 25 is also covered with the metal plate 26, so that the aesthetic appearance is also excellent. A resin may be used instead of the metal plate 26.

Figure 10:
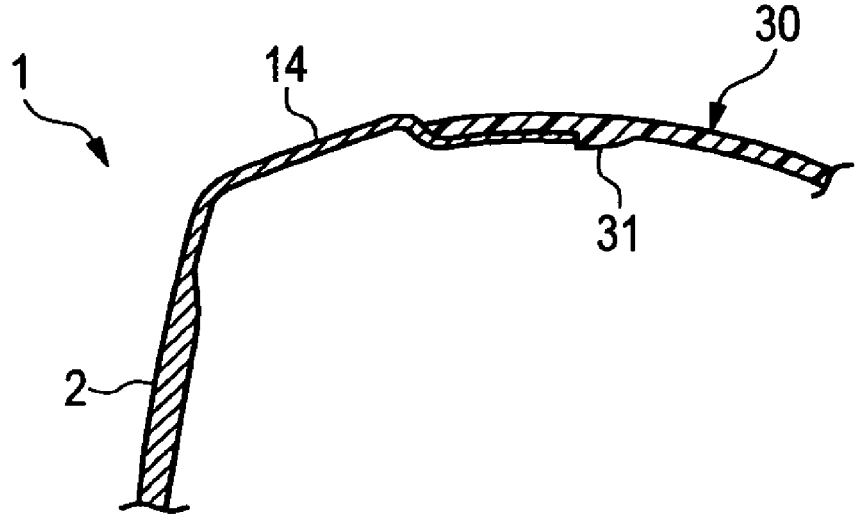
FIG. 10 is a section view illustrating another embodiment.
Figure 11:
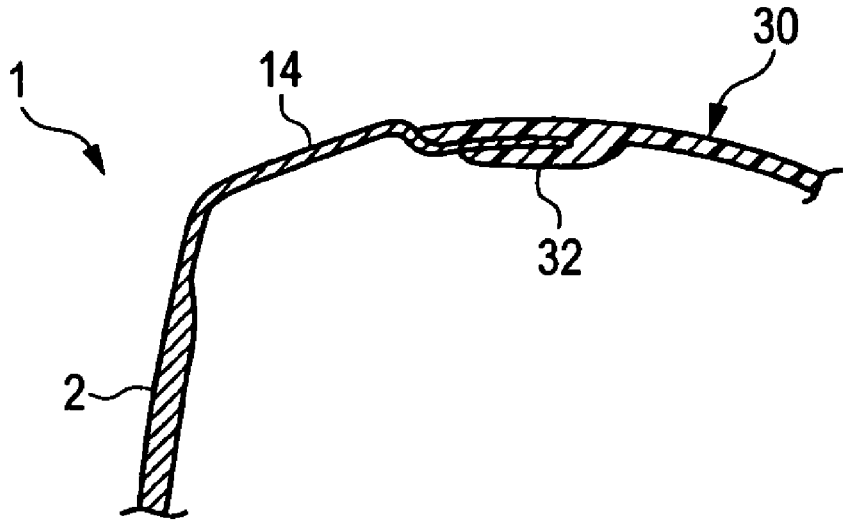
FIG. 11 is a section view illustrating still another embodiment.
Figure 12:
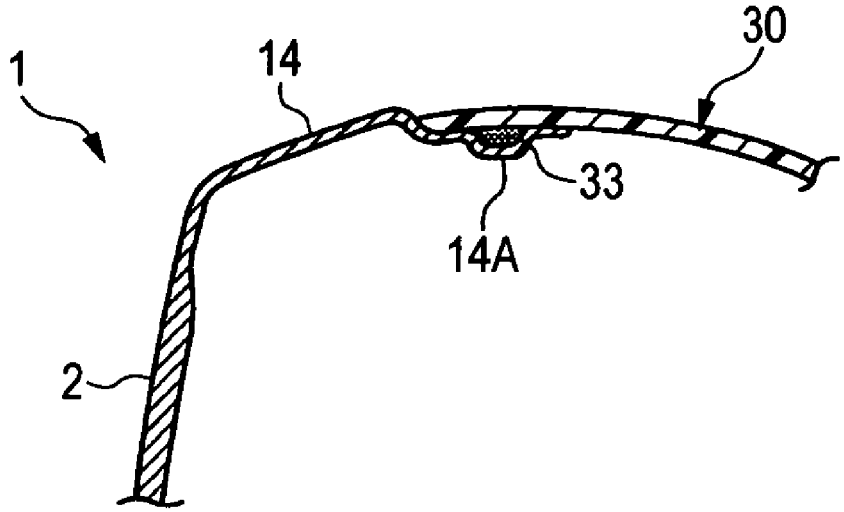
FIG. 12 is a section view illustrating a further embodiment.

In the invention, it is possible to adopt structures as shown in FIGS. 10, 11, and 12 to enhance the bonding strength between the FRP body 30 and the metal body 10.

In FIG. 10, a protruding portion 31 abutting against an end face of the metal body 10 (in this case, the metal side portion 14) is provided on the inner surface of the FRP body 30.

In FIG. 11, an overlay portion 32 clamping an end of the metal body 10 (in this case, the metal side portion 14) is provided on the inner surface of the FRP body 30.

In FIG. 12, recess 14A is formed in the metal body 10 (in this case, the metal side portion 14). Since a bonding adhesive 33 is filled in this recess 14A, the FRP body 30 and the metal side portion 14 are bonded together.

EXAMPLES

The illustrated golf club head was manufactured in which Ti-6Al-4V is used as the material of the metal body 10 and tungsten is used as the material of the weight members 20 and 25, and carbon fiber prepregs are used for the FRP body. The shaft was fitted to this golf club head, to thereby form a golf club. Twenty testers whose club head speeds were in a range of 40 m/sec to 48 m/sec tested the golf clubs, and sensory evaluation and flight-distance evaluation were conducted. The loft angles were 9.5° in Example 1 and 10° in Example 2. The first weight member weighed 10 g, and the second weight members weighed 10 g, respectively.

A golf club head in which the first and second weight members were omitted was manufactured as Comparative Example 1; a golf club head in which only the first weight member was used was manufactured as Comparative Example 2; and a golf club head made of only metal was manufactured as Comparative Example 3, and similar evaluations were conducted. The results are shown in the following table.

| | Example 1 | | Example 2 | | Comparative Example 1 | | Comparative Example 2 | | Comparative Example 3 | |
|---|---|---|---|---|---|---|---|---|---|---|
| | g | % | g | % | g | % | g | % | g | % |
| Loft angle | 9.5 degs | | 10 degs | | 9.5 degs | | 10 degs | | 9.5 degs | |
| Metal portion | 126 | 66% | 130 | 67% | 80 | 42% | 150 | 79% | 190 | 100% |
| Carbon portion | 34 | 18% | 35 | 18% | 100 | 53% | 40 | 21% | 0 | 0% |
| Tungsten | 30 | 16% | 30 | 15% | 0 | 0 | 10 | 5% | 0 | 0% |
| Head weight | 190 | | 195 | | 190 | | 190 | | 190 | |
| Flight distance | ◎ | | ◎ | | X | | ○ | | X | |
| Hit feeling | ◎ | | ◎ | | ○ | | X | | ◎ | |

As shown in the table, the golf club heads of the Examples were excellent in both the flight distance and the hit feeling.

What is claimed is:

1. A hollow golf club head comprising:

a face portion made of metal;

a sole portion;

a side portion;

a crown portion;

a hosel portion, and a first weight member made of a metal material, wherein:

a front edge portion of the side portion and a front edge portion of the sole portion are made of the metal and are continuous with the face portion, a the metallic portion of the sole portion extends to a rear face portion of the golf club head, and the first weight member is provided at a rear portion of the metallic portion of the sole portion; wherein:

the crown portion comprises:

a main portion made of a fiber reinforced resin; and a front edge portion made of the metal, the front edge portion of the crown portion is continuous with the face portion, the sole portion comprises a center portion made of the metal in a toe-heel direction, and a weight of a portion made of the fiber reinforced resin including the main portion of the crown portion is in a range of 5% to 30% of a total weight of the golf club head.

2. The golf club head according to claim 1, wherein a weight of the first weight member is in a range of 10% to 25% of the total weight of the golf club head.

3. The golf club head according to claim 1, wherein a sole-face side of the first weight member is covered with a metal or a resin.

4. The golf club head according to claim 1, further comprising:

a second weight member made of a metal material provided in a front portion of the metallic portion of the sole portion.

5. The golf club head according to claim 4, wherein:

the second weight member is a plurality of second weight members, and the second weight members are provided on a toe side and a heel side of the sole portion, respectively.

6. The golf club head according to claim 5, wherein a sole-face side of the second weight member is covered with a metal or a resin.

7. The golf club head according to claim 5, wherein:

a groove portion, which is recessed from a sole face and extends in the toe-heel direction, is formed around the recess, and a fiber reinforced resin continuous with the main portion of the crown portion is disposed in the groove portion to cover the second weight member.

8. The golf club head according to claim 5, wherein:

recesses are formed in the sole portion on the toe side and the heel side, respectively, and the second weight members are disposed in the respective recesses.

9. The golf club head according to claim 8, wherein the recesses are narrowest nearest the center portion of the sole portion.

10. The golf club head according to claim 4, wherein:

a recess recessed from a sole surface is formed in the metallic portion of the sole portion, and the second weight member is disposed in the recess.

11. The golf club head according to claim 1, wherein:

the face portion is formed of a face plate made by forging or press-molding, components of the golf club head other than the face portion are made by casting, and the face plate is fixed to the cast components.

12. The golf club head according to claim 11, wherein a thickness of the face plate in a vicinity of a center portion thereof is larger than that of a peripheral edge portion of the face plate.

13. The golf club head according to claim 1, wherein the metallic portion of the sole portion rises obliquely at the rear face portion of the club head.

* * * * *